US010513825B2

(12) United States Patent
Ibrahim

(10) Patent No.: US 10,513,825 B2
(45) Date of Patent: Dec. 24, 2019

(54) PAPER MANUFACTURING SYSTEM

(71) Applicant: Ahmed Ibrahim, Westerville, OH (US)

(72) Inventor: Ahmed Ibrahim, Westerville, OH (US)

( * ) Notice: Subject to any disclaimer, the term of this patent is extended or adjusted under 35 U.S.C. 154(b) by 178 days.

(21) Appl. No.: 15/707,640

(22) Filed: Sep. 18, 2017

(65) Prior Publication Data

US 2019/0085510 A1 Mar. 21, 2019

(51) Int. Cl.
*D21F 1/02* (2006.01)

(52) U.S. Cl.
CPC ..... *D21F 1/026* (2013.01)

(58) Field of Classification Search
None
See application file for complete search history.

(56) References Cited

U.S. PATENT DOCUMENTS 2,832,268 A * 4/1958 Gardner ..... D21F 1/02 162/216
2,881,674 A * 4/1959 Russell ..... D21F 1/02 162/216
3,092,538 A * 6/1963 Parker ..... D21F 1/02 162/216
3,092,540 A * 6/1963 Parker ..... D21F 1/02 162/336
3,103,463 A * 9/1963 Justus ..... D21F 1/02 162/341
3,220,919 A * 11/1965 Parker ..... D21F 1/02 162/272
3,309,264 A * 3/1967 Parker ..... D21F 1/02 162/336
6,047,834 A 4/2000 Dolle et al.
6,368,460 B1 4/2002 Aidun
6,524,441 B2 2/2003 Ruf et al.
6,799,083 B2 9/2004 Chen et al.
7,578,906 B2 8/2009 Shands et al.
9,309,623 B2 4/2016 Faufau et al.
2002/0117285 A1 8/2002 Aidun
2003/0056924 A1* 3/2003 Haraldsson ..... D21F 1/02 162/336
2009/0139673 A1 6/2009 Resch

* cited by examiner

*Primary Examiner* — Dennis R Cordray

(57) ABSTRACT

A paper manufacturing system includes a paper machine that has a headbox to contain a slurry of fluid mixed with cellulosic fibers. The headbox has an opening therein to direct the slurry outwardly from the headbox. A turbulence unit is positioned within the headbox to agitate the slurry when the slurry travels through the headbox and out of the opening. In this way the turbulence unit facilitates a random organization of the cellulosic fibers in the slurry when the slurry leaves the headbox. The turbulence unit includes a plurality of cylinders and each of the cylinders urges the slurry to swirl into a plurality of eddies when the slurry passes around each of the cylinders. Each of the cylinders is comprised of a carbon fiber material to inhibit adhesion between the cellulosic fibers and the cylinders.

6 Claims, 4 Drawing Sheets

PAPER MANUFACTURING SYSTEM

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to manufacturing devices and more particularly pertains to a new manufacturing device for manufacturing paper with enhanced strength.

BRIEF SUMMARY OF THE INVENTION

An embodiment of the disclosure meets the needs presented above by generally comprising a paper machine that has a headbox to contain a slurry of fluid mixed with cellulosic fibers. The headbox has an opening therein to direct the slurry outwardly from the headbox. A turbulence unit is positioned within the headbox to agitate the slurry when the slurry travels through the headbox and out of the opening. In this way the turbulence unit facilitates a random organization of the cellulosic fibers in the slurry when the slurry leaves the headbox. The turbulence unit includes a plurality of cylinders and each of the cylinders urges the slurry to swirl into a plurality of eddies when the slurry passes around each of the cylinders. Each of the cylinders is comprised of a carbon fiber material to inhibit adhesion between the cellulosic fibers and the cylinders.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
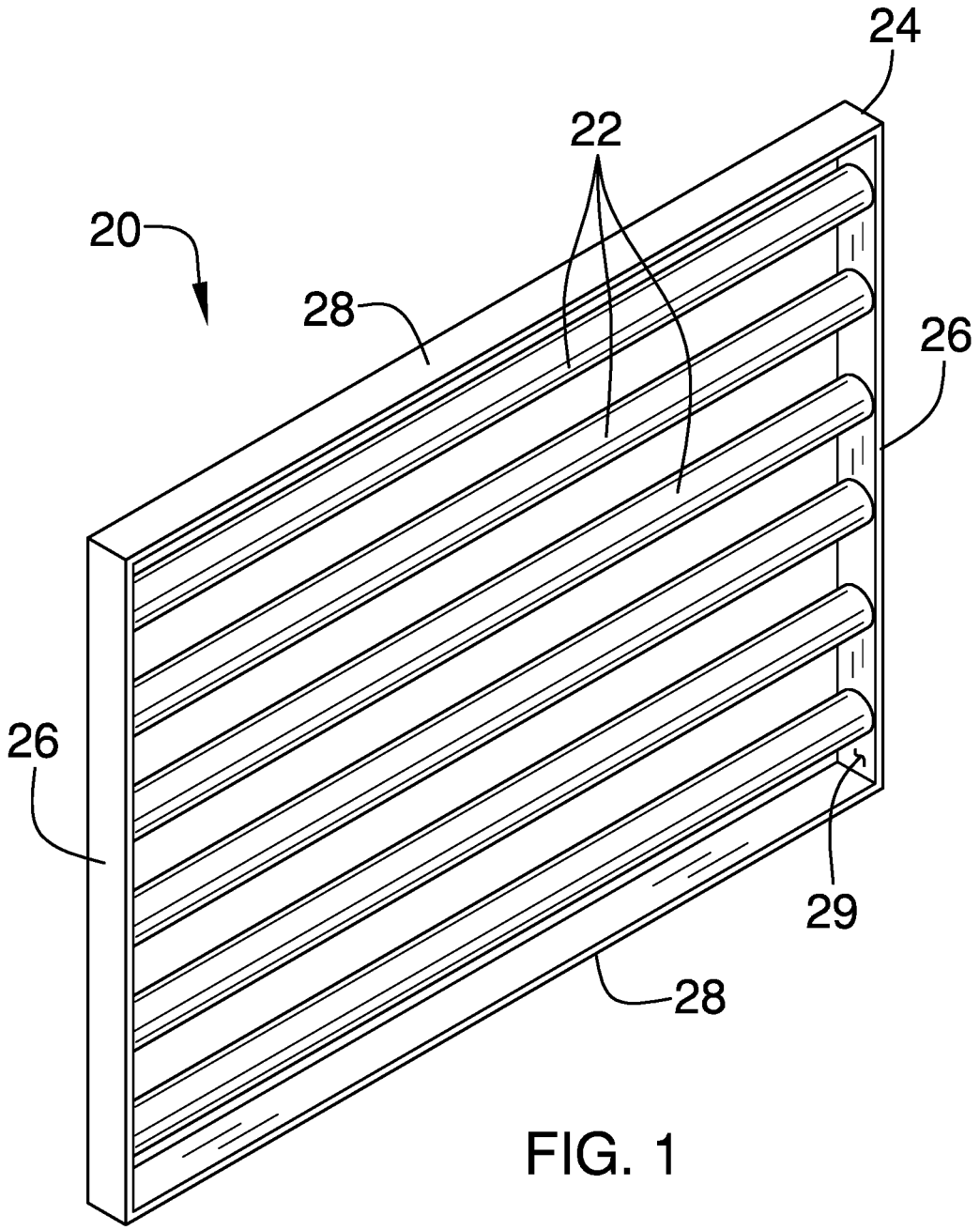
FIG. 1 is a front perspective view of a paper manufacturing system according to an embodiment of the disclosure.
Figure 3:
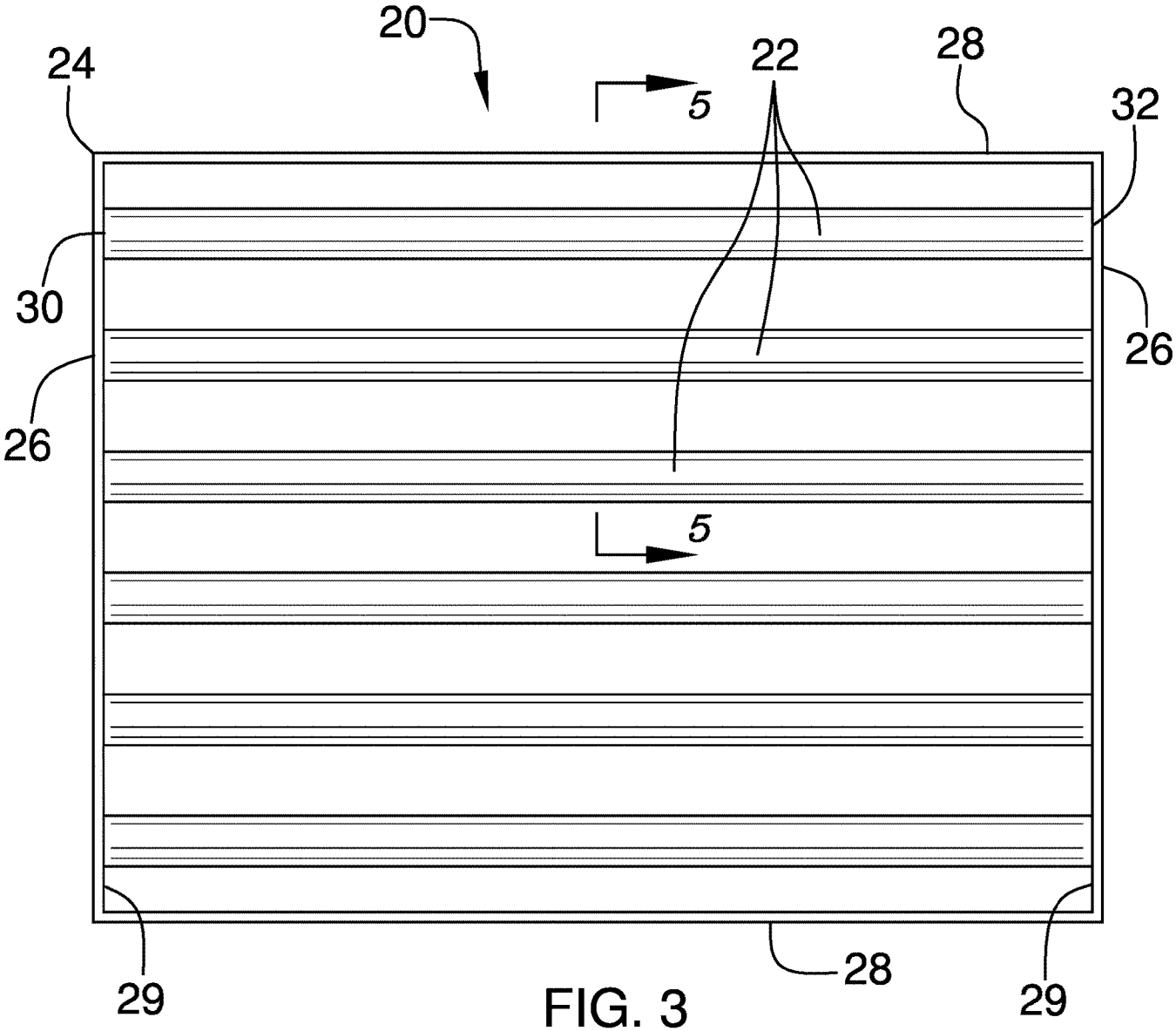
FIG. 3 is a back view of an embodiment of the disclosure.
Figure 2:
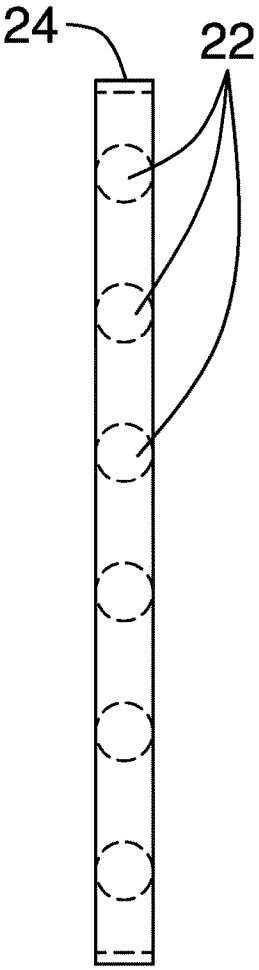
FIG. 2 is a right side phantom view of an embodiment of the disclosure.
Figure 4:
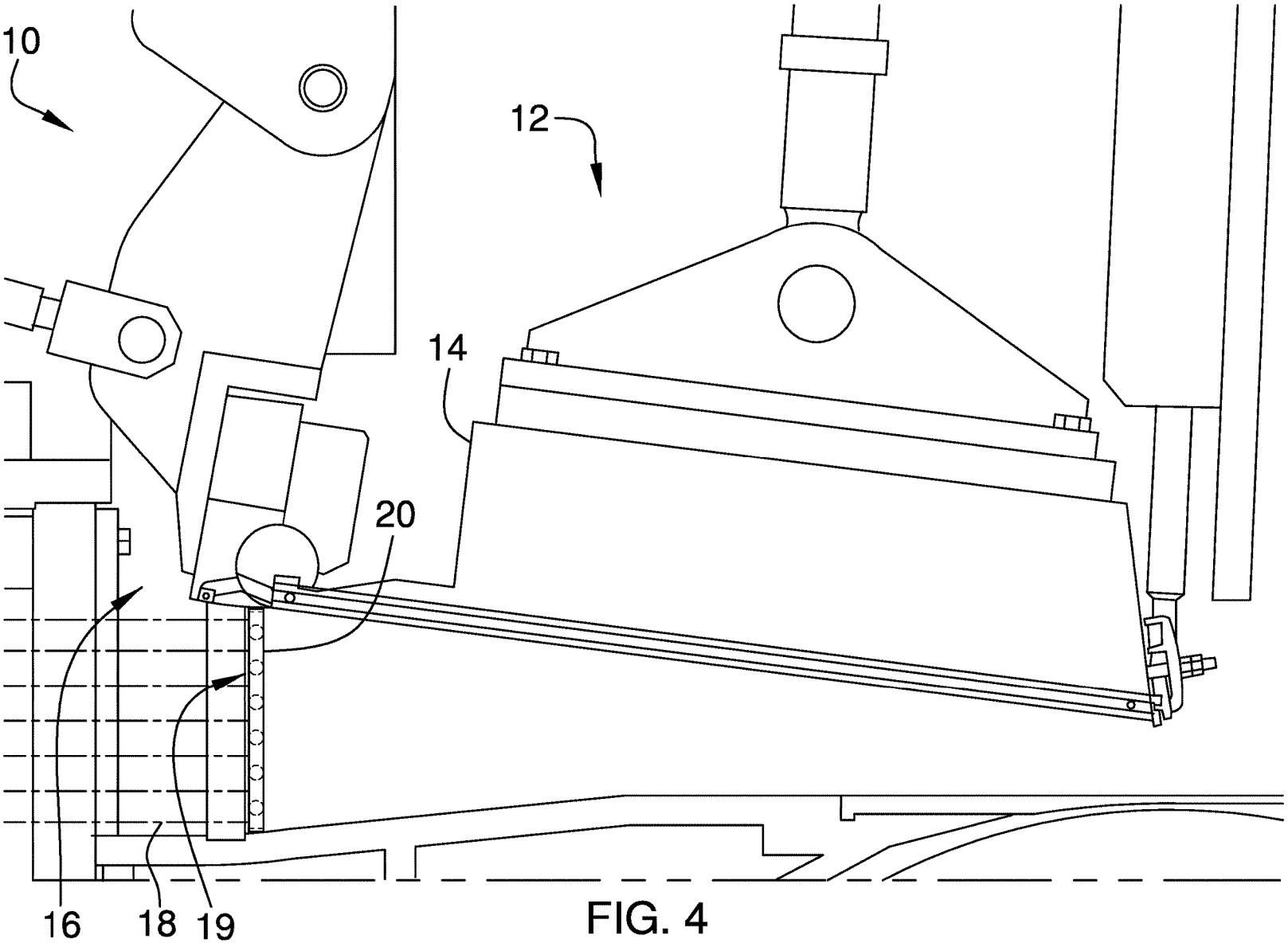
FIG. 4 is a perspective in-use view of an embodiment of the disclosure.
Figure 5:
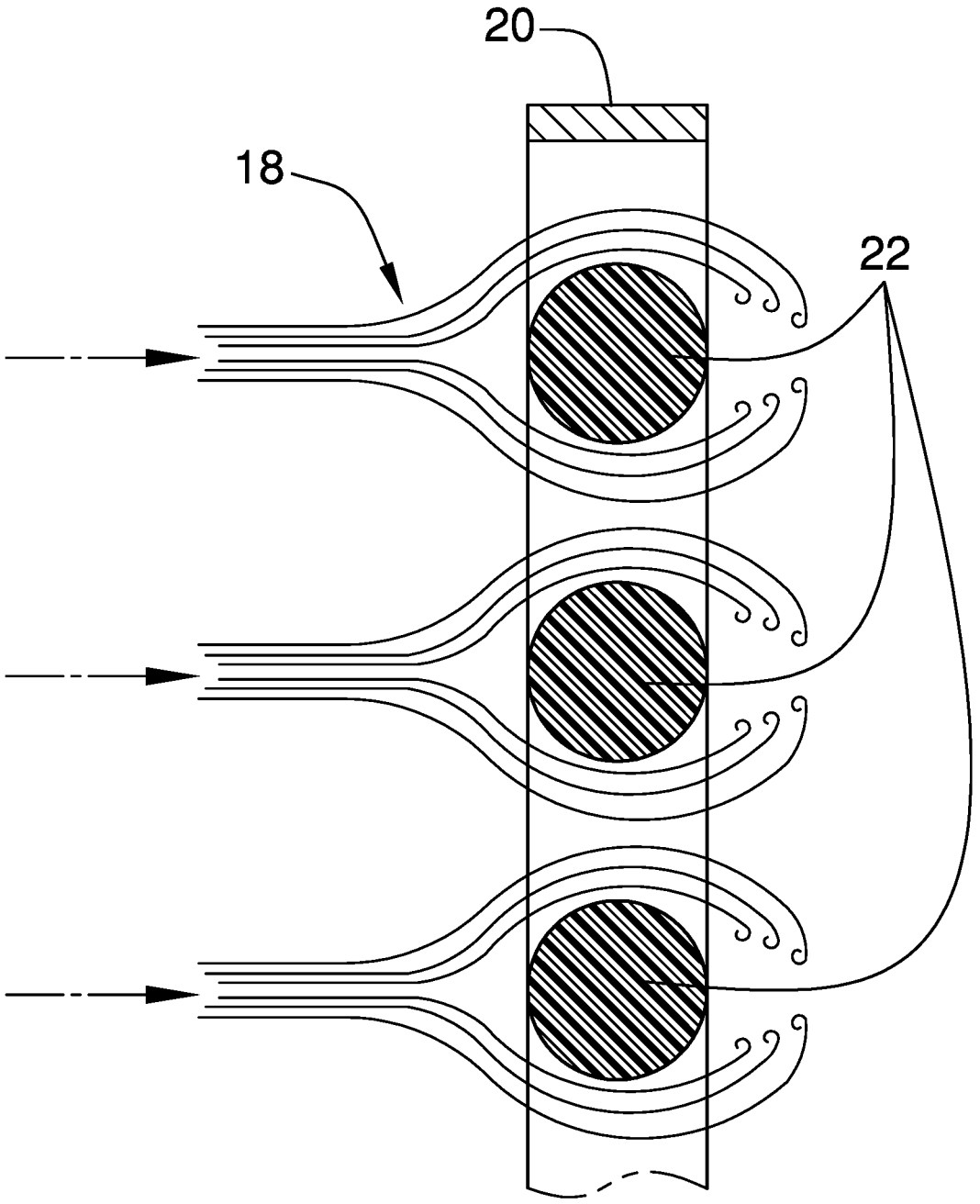
FIG. 5 is a cross sectional view taken along line 5-5 of FIG. 3 of an embodiment of the disclosure.

With reference now to the drawings, and in particular to FIGS. 1 through 5 thereof, a new manufacturing device embodying the principles and concepts of an embodiment of the disclosure and generally designated by the reference numeral 10 will be described.

As best illustrated in FIGS. 1 through 5, the paper manufacturing system 10 generally comprises a paper machine 12 that has a headbox 14 and a conveyor belt 16. The headbox 14 contains a slurry 18 of fluid mixed with cellulosic fibers. Additionally, the headbox 14 has an opening 19 therein to direct the slurry 18 outwardly from the headbox 14 and onto the conveyor belt 16. The paper machine 12 may be a paper manufacturing machine employed in an industrial manufacturing environment. Additionally, the slurry 18 may be a slurry 18 employed to manufacture any type of paper product.

The orientation of the cellulosic fibers in parallel to the direction of flow through the paper machine 12 is called machine direction (MD). The orientation of the cellulosic fibers perpendicular to the direction of flow through the paper machine 12 is called cross direction (CD). An isotropic slurry comprises a perfect symmetry between MD and CD, and an anisotropic slurry comprises an imbalance between MD and CD. The cellulosic fibers form an interconnected web when the slurry 18 is deposited onto the conveyor belt 16. Additionally, the cellulosic fibers tend to be preferentially oriented in MD due to viscous shear, friction and acceleration forces when the slurry 18 flows through the headbox 14. The resulting anisotropic slurry 18 deposited on the conveyor belt 16 produces a paper that has reduced strength properties compared to paper produced from an isotropic slurry 18.

A turbulence unit 20 is provided and the turbulence unit 20 is positioned within the headbox 14. The turbulence unit 20 agitates the slurry 18 when the slurry 18 travels through the headbox 14 and out of the opening 19. In this way the turbulence unit 20 facilitates a random organization of the cellulosic fibers in the slurry 18 thereby producing paper with enhanced tensile strength.

The turbulence unit 20 includes a plurality of cylinders 22. Each of the cylinders 22 urges the slurry 18 to swirl into a plurality of eddies when the slurry 18 passes around each of the cylinders 22 in accordance with the Coanda effect. In this way the turbulence unit 20 facilitates a more isotropic slurry 18 to be deposited onto the conveyor belt 16 thereby producing paper with enhanced strength properties. Additionally, each of the cylinders 22 is comprised of a carbon fiber material to inhibit the cellulosic fibers from adhering to the cylinders 22. The carbon fiber material may be a carbon fiber nanotube or the like.

The turbulence unit 20 comprises a frame 24 that has a pair of first members 26 each extending between a pair of second members 28. The first members 26 are spaced apart from each other such that the frame 24 has a rectangular shape. Each of the first members 26 has a first surface 29 and the first surface 29 corresponding to each of the first members 26 is directed toward each other.

Each of the cylinders 22 has a first end 30 and a second end 32. The first end 30 corresponding to each of the cylinders 22 is coupled to the first surface 29 of a corresponding one of the first members 26. The second end 32 corresponding to each of the cylinders 22 is coupled to the first surface 29 of a corresponding one of the first members 26. Additionally, the cylinders 22 are spaced apart from each other and are distributed between the second members 28. The turbulence unit 20 is oriented such that the slurry 18 flows perpendicular to an axis extending through the first 30 and second 32 ends of the cylinders 22. Thus, the slurry 18 flows around and between the cylinders 22.

In use, the turbulence unit 20 is mounted in a selected manner within the headbox 14. Additionally, the turbulence unit 20 is positioned such that the slurry 18 flows perpendicular to the cylinders 22. Each of the cylinders 22 produces eddies in the slurry 18 when the slurry 18 flows around the cylinders 22. In this way the cellulosic fibers in the slurry 18 are randomly mixed thereby facilitating the slurry 18 to be isotropic. The resulting isotropic slurry 18 is deposited onto the conveyor belt 16 thereby producing paper with enhanced strength in CD and enhanced elongation in MD. Additionally, the turbulence unit 20 disrupts flow instabilities that are generated from various components located upstream from the turbulence unit 20.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A paper manufacturing system being configured to enhance tensile strength of paper during the manufacturing process, said system comprising:

a paper machine having a headbox being configured to contain a slurry of fluid mixed with cellulosic fibers, said headbox having an opening therein wherein said opening is configured to direct the slurry outwardly from said headbox; and a turbulence unit being positioned within said headbox wherein said turbulence unit is configured to agitate the slurry when the slurry travels through said headbox and out of said opening thereby facilitating a random organization of the cellulosic fibers in the slurry when the slurry leaves said headbox, said turbulence unit comprising a plurality of cylinders wherein each of said cylinders is configured to urge the slurry to swirl into a plurality of eddies when the slurry passes around each of said cylinders, each of said cylinders being comprised of a carbon fiber material wherein each of said cylinders is configured to inhibit adhesion between the cellulosic fibers and said cylinders, and a frame having a pair of first members each extending between a pair of second members, said first members being spaced apart from each other such that said frame has a rectangular shape, each of said first members having a first surface, said first surface corresponding to each of said first members being directed toward each other.

2. The assembly according to claim 1, wherein each of said cylinders has a first end and a second end.

3. The assembly according to claim 2, wherein said first end corresponding to each of said cylinders is coupled to said first surface of a first one of said first members.

4. The assembly according to claim 3, wherein said second end corresponding to each of said cylinders is coupled to said first surface of a second one of said first members.

5. The assembly according to claim 2, wherein said cylinders are spaced apart from each other and are distributed between said second members.

6. A paper manufacturing system being configured to enhance tensile strength of paper during the manufacturing process, said system comprising:

a paper machine having a headbox being configured to contain a slurry of fluid mixed with cellulosic fibers, said headbox having an opening therein wherein said opening is configured to direct the slurry outwardly from said headbox; and a turbulence unit being positioned within said headbox wherein said turbulence unit is configured to agitate the slurry when the slurry travels through said headbox and out of said opening thereby facilitating a random organization of the cellulosic fibers in the slurry, said turbulence unit including a plurality of cylinders wherein each of said cylinders is configured to urge the slurry to swirl into a plurality of eddies when the slurry passes around each of said cylinders, each of said cylinders being comprised of a carbon fiber material wherein each of said cylinders is configured to inhibit adhesion between the cellulosic fibers and said cylinders, said turbulence unit comprising:

a frame having a pair of first members each extending between a pair of second members, said first members being spaced apart from each other such that said frame has a rectangular shape, each of said first members having a first surface, said first surface corresponding to each of said first members being directed toward each other, and each of said cylinders having a first end and a second end, said first end corresponding to each of said cylinders being coupled to said first surface of a first one of said first members, said second end corresponding to each of said cylinders being coupled to said first surface of a second one of said first members, said cylinders being spaced apart from each other and being distributed between said second members.

* * * * *